US005839333A

United States Patent [19]

McKay

[11] Patent Number: 5,839,333

[45] Date of Patent: Nov. 24, 1998

[54] ARTICULATED HOLLOWING SYSTEM FOR LATHE

[76] Inventor: Hugh E. McKay, 95623 Riverway Dr., Gold Beach, Oreg. 97444

[21] Appl. No.: 753,998

[22] Filed: Dec. 4, 1996

[51] Int. Cl.[6] ..... B27C 7/06

[52] U.S. Cl. ..... 82/1.11; 82/1.2; 142/49; 142/38

[58] Field of Search ..... 82/1.11, 1.2, 1.4, 82/1.5; 142/1, 56, 47, 48, 49

[56] References Cited

U.S. PATENT DOCUMENTS

| | | | |
|---|---|---|---|
| 4,345,631 | 8/1982 | Lemler | 145/24 |
| 4,615,365 | 10/1986 | Arnall | 142/49 |
| 4,830,069 | 5/1989 | Milyard | 144/1 C |
| 4,924,924 | 5/1990 | Stewart | 142/49 |
| 5,224,529 | 7/1993 | Kenny | 142/42 |
| 5,333,657 | 8/1994 | Hart | 142/24 |
| 5,441,089 | 8/1995 | Lazarou | 142/49 |

*Primary Examiner*—Andrea L. Pitts
*Assistant Examiner*—Mark Williams

[57] ABSTRACT

A manually directed lathe tool system for removal of internally disposed material and creating a void inside a lathe turned form. As shown in FIG. 1, an articulated boring bar (32) of a tubular crosssection is slidably manipulated and supported by a plane surface (140) during a cutting action. To increase offset cutting ability several different lengths of a detachable and hinged arm assembly (40) are used. Arm assembly can be fixed or moved to three different positions relative to boring bar (FIG. 2) by manipulating a hand knob (36). A moveable and replaceable cutting tool (198) is held at the end of the arm assembly. A wall thickness caliper system (44) which ends in a tip (130) of some flexible material to allow operator appraisal of the internally disposed cutting tool's position. A back restraint assembly (141) is used to prevent the downward pitch of the boring bar's cutting end during material removal and consequent upward pitch of the opposite end of the boring bar, and especially during a highly leveraged cutting action. An outrider (38) attached to the boring bar prevents rotational movement of the tool relative to its longitudinal axis, especially during a leveraged offset cutting action. The outrider is able to be attached at several different locations on the boring bar and also serves as the support for the caliper system. Platform base (34B) is mounted rigidly to the lathe bed (30) and maintains platform assembly (34A) at a proper height. A precise wall thickness that mirrors the outside form can be achieved with this system. The system can be used to hollow-out forms not possible with previous practice. A narrow and restricted mouth opening does not hinder hollowing-out large diameters and deep forms. The operator is in control during all leveraged cutting actions and experiences minimal operator fatigue.

20 Claims, 15 Drawing Sheets

ARTICULATED HOLLOWING SYSTEM FOR LATHE

BACKGROUND

1. Field of Invention

This invention relates to the tools and implements for the manual removal of internally disposed material in a lathe tamed form leaving an internal void with a predetermined wall thickness.

2. Description of Prior Art

The following terms and their strict definitions are introduced here as an aid in the understanding of this specification:

"Hollowing-out: removal of material from the end of a lathe turned form, said end being perpendicular to the form's turning axis and opposite the form's end that is mounted to the lathe. Material removal resulting in an interior void of accurate and consistent wall thickness that mirrors the outside form."

"Limited-access opening: the mouth diameter of the form to be hollowed-out is not substantially greater than the diameter of the boring bar being used for the hollowing-out process, allowing minimal side to side and angular movement of the boring bar."

The process of removing solid material (usually wood) with a hand held cutting tool and hollowing out a turned form is a difficult procedure. Contending with restricted tool movement and a limited visibility condition (blind boring), the lathe operator has a challenging task. A well-made, thin-walled and small-mouthed vase form (small-mouthed relative to the outside diameter of the form) is considered the epitome of good craftsmanship by many wood turners due to the challenges in making.

When hollowing-out, the lathe operator is concerned with two directional forces that develop with a lathe tool during a cut. The operator must control these forces exerted on the tool in order to produce quality work efficiently. These problems, along with several others are listed for discussion:

1) Tool pitch: the teeter-totter motion of a hand held lathe tool that develops during a cutting action with the tool rest acting as a fulcrum.

As the lathe operator extends the cutting tool over the edge of the tool rest, tool pitch increases. The downward movement of the cutting tip during a cutting action in the spinning form must be overcome by the operator. The resultant upward movement of the opposite end of the tool must be physically controlled by the operator. During a highly leveraged cutting action, loss of operator control is always present. Mental anxiety and physical fatigue result.

With an increase in tool pitch, the skill, strength and sensitivity of the operator must also increase. It can take years of practice before an operator of these hand held tools can develop sufficient confidence and technique to get much depth or breadth of cut to successfully and consistently hollow-out turned forms.

2) Tool Roll: rotational force that develops during a cut because a lathe tool's cutting tip deviates or is offset from the tool's longitudinal axis.

In order to hollow-out forms that have much of a "shoulder" or curvature to the form (relative to the mouth), lathe tools that are bent or curved near their cutting tip are commonly used. If this bend or curve deviates from the longitudinal axis of the lathe tool, then axial rotation or tool roll develops during a cutting action. The operator must physically overcome this force when attempting to cut, resulting in operator fatigue. An operator can take years to learn to deal with this particular torsional force when attempting to hollow-out a turned form.

3) Achieving accurate wall thickness:

Another problem to overcome, particularly when hollowing-out a limited-access large diameter form, is calibrating the exact wall thickness. With a limited access form, the operator cannot see the cutting tip or easily monitor its position in relationship to the outside of the form. During this blind boring process, the operator can easily pierce through the form when hollowing-out to a thin wall. A method to keep track of the position of the internally disposed cutting tool relative to the outside form would alleviate this problem, especially during a cutting action.

4) Lack of ability offered by conventional practice to hollow-out many types of turned forms:

The type of form that can be hollowed-out with conventional practice is of a basic spheroid shape. A skilled operator of the lathe can easily create many types of forms that would prove impossible to hollow-out with these conventional practices.

Several patents have tried to deal with some of these problems, but these had and still have significant problems.

A) U.S. Pat. No. 4,924,924 to Stewart (1990) attempts to control resultant tool pitch exerted on a lathe tool during a cutting action by an elaborate handle system that ties or straps the operator's forearm to the cutting tool. However, this system still places physical demands on the operator. This invention still depends upon a high level of operator skill as the cutting tip is further extended from the tool rest. As this distance increases, so does resultant operator fatigue. The operator can experience anxiety if during a highly leveraged cutting action the cutting tip "catches" (a sudden directional change of the cutting tool during a cut that results in temporary loss of operator control) in the material with this tool handle system so securely a part of the operator's arm.

This same tool system attempts to deal with tool roll of an offset cutting tool by keeping the cutting tip in line with the longitudinal axis of the main shaft of the tool (FIG. 11, #74 of Stewart) and having the curved part of the tool run off-axis behind and supporting the cutting tip. This design does allow control of tool roll but with a fixed and limited amount of offset. This inflexible solution to the problem of tool roll severely compromises the turned form designs that can be hollowed-out.

There is no obvious way to monitor wall thickness during blind boring with the Stewart patent. The operator must stop the lathe often to measure wall thickness, a very time consuming process. Even with the advantages this tool system offers over previous practice, the process of hollowing-out with this method is still very laborious, fatiguing and time consuming.

B) U.S. Pat. No. 4,615,365 to Arnall (1986) is another attempt to deal with some of the problems of hollowing-out turned forms. A claim of this tool support is "to restrain rotational movement of such chisel or tool about its longitudinal axis" (Arnall, 1986) or what this specification has defined as tool roll. The conventional practice with this tool support system would be to use a tool of a square or rectangular cross-section. Conventionally found lathe tools are to be used with it. A very heavy conventional tool would have dimensions of 25 mm wide and 13 mm thick. A conventional amount of offset to this tool would be 13 mm to 38 mm at a 45 degree angle from the tool's shank. My articulated hollowing system uses an offset cutting tip up to 9 times the width of the main shank of a tool or 229 mm at 90 degrees for a tool of the size discussed above. The amount of tool roll developed by an offset of 152 mm at 90 degrees from the tool's shank (a commonly used amount of offset with my system) would be over 4 times greater than the extreme conventionally used length of 38 mm at 45 degrees.

Due to the design and purpose of this tool support, this much increase in tool roll torque would make the sliding action of this offset tool shank through the "parallel sided slot" (Arnall, 1986) during a cutting action very difficult. The operator would be fighting "tool bind" in this parallel sided slot, a strain that this system was not designed to deal with. A square sectioned tool would bind up even more easily than a rectangular tool with the same amount of tool roll torque. Indeed, Arnall (1986) advises to use rectangular tools rather than square tools, so obvious is this problem. This problem is due to the small amount of surface area used to deal with this force. To sum up, only tools of a square or rectangular cross section with a very limited amount of offset can be used with the Arnall tool support. The design of this tool support system is very limiting to the type of tools and implements that can be used with it.

Lathe tool shanks of a cylindrical design, especially if the cutting tip is offset would not work at all with the Arnall tool support. A round tool shank would easily rotate or spin away from the cut, unable to be held by the Arnall tool rest. Cylindrical tools have a greater amount of tool movement potential in a round hole than a square or rectangular tool of equal strength or rigidity. The ability to use cylindrical tools is important when hollowing-out where lathe tool movement is restricted by a limited-access opening.

The fixed nature of the Arnall tool's space between the upper and lower bars ("preferably of welded construction", Arnall, 1986) demands that only a certain thickness of tool can be used. This is a severe limitation to the size and type of tools that can be used with it and the resultant forms that can be hollowed-out.

Due to the design of the Arnall tool support, there is also a very restricted horizontal movement allowed any tool used with it. The support platform is very narrow and if a large mouthed form is to be hollowed-out, this invention would need to be moved often to keep the tool in a proper position for material removal. It was designed for small work or small-mouthed work only. Due to the very narrow platform design and small amount of surface area offered to hold a tool and its implements, the types of tools and resultant forms that can be hollowed-out are again severely limited. Indeed, the types of tooling that my system uses could not be used with the narrow Arnall support platform.

The Arnall tool support was designed to be used in conjunction with a wood lathe's existing tool rest holder. The tool rest holder of a wood lathe was made to control the downward force that a lathe tool develops when cutting. The corresponding upward force on the opposite end of the tool is controlled by the operator. The Arnall tool support was designed to help control lathe tool pitch. When the Arnall tool support is in use with a lathe's existing tool rest holder, it will subject that tool rest holder to the resultant pitch force of the lathe tool in use. A wood lathe's tool rest holder was not made to control the teetertotter motion of tool pitch. A tool rest holder was made to resist the compression from the downward force developed by a lathe tool during a cutting action. Not the flexing or deflection that will develop using the Arnall tool support attached to it. Vibration will quickly develop during a leveraged cutting action when the tool rest holder starts to deflect.

The post of a conventional tool rest for a wood lathe is of an appropriate diameter for the compressional force it will have to control, not the deflection it will have to endure with the Arnall system. By necessity, the Arnall tool support uses the same size diameter post as the tool rest. Again, vibration from the support system of the Arnall will have to be endured by the operator with just a low leveraged cutting action. The seeming stability offered by this invention will be compromised by its dependency on another tool system that was not designed to deal with lathe tool pitch or tool roll, particularly during a leveraged cutting action.

Objects and Advantages

Accordingly, several objects and advantages of the my articulated hollowing system are:

(a) to provide a system which is much safer to use than any other conventional method. Any "catch" in the material being removed by the cutting tool is restrained and controlled by the system and not the operator.

(b) to provide a system that is conducive to less operator fatigue than any other method. The operator experiences no physical duress from the two forces already discussed. This is due to the fact that all tool pitch and roll is totally controlled by the system.

(c) to provide a system that is easier to learn and use than any other method. A beginner requires little instruction and practice to quickly and successfully master the techniques of this system in order to accomplish a previously difficult task.

(d) to provide a system capable of greater precision and accuracy than any other method. An accurate and uniform wall thickness can be achieved with the use of the system's modular caliper assembly.

(e) to provide a system that is able to hollow-out a turned form faster than other methods. This system can use very aggressive cutting tools due to the high degree of control the operator has over the offset boring bar.

(f) to provide a system that is solid enough, large enough and versatile enough to handle more types of tools and implements than any other methods. Tools other than my articulated boring bar can easily be adapted to use with this system. Tool vibration during a leveraged cutting action is minimized due to the design of this system.

(g) to provide a system that allows a greater range of design possibilities in the turned forms that can be hollowed-out. A long neck with a small diameter but with a large diameter body is an example of a type of form that is impossible to hollow-out with any other conventional method. This form can be done routinely with this system.

(h) to provide a system that will allow the lathe operator greater creativity. Turned and hollowed vessel forms have been produced for a number of years using conventional practices. This system will allow an increase in creativity in this area of craft work due to all the objects and advantages listed above.

Still further objects and advantages will become apparent from a consideration of the ensuring description and drawings.

DRAWING FIGURES

In the drawings, closely related figures have the same number but different alphabetic suffixes.

Description of FIGS. 1 through 16

Figure 1:
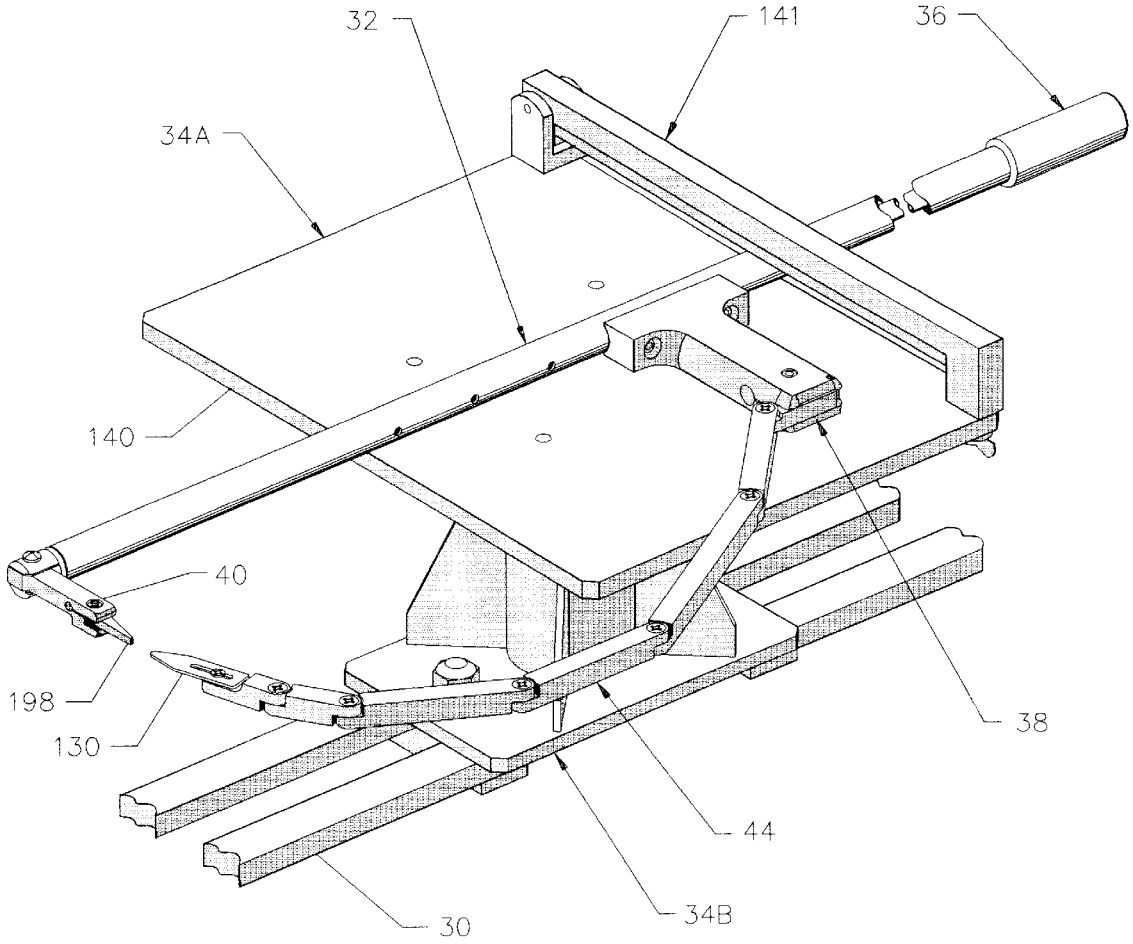
FIG. 1 is a perspective view of a lathe tool assembly embodying the invention.

A typical embodiment of the articulated hollowing system of the present invention is illustrated in FIG. 1 (perspective view). A platform mounting assembly 34B is securely bolted to the lathe bed ways 30 (the lathe bed ways are not part of the invention but are introduced here only for clarification). Mounting assembly 34B secures a platform assembly 34A. It is upon platform assembly 34A that an articulated boring bar assembly 32 is slidably manipulated during its operation.

Figure 2:
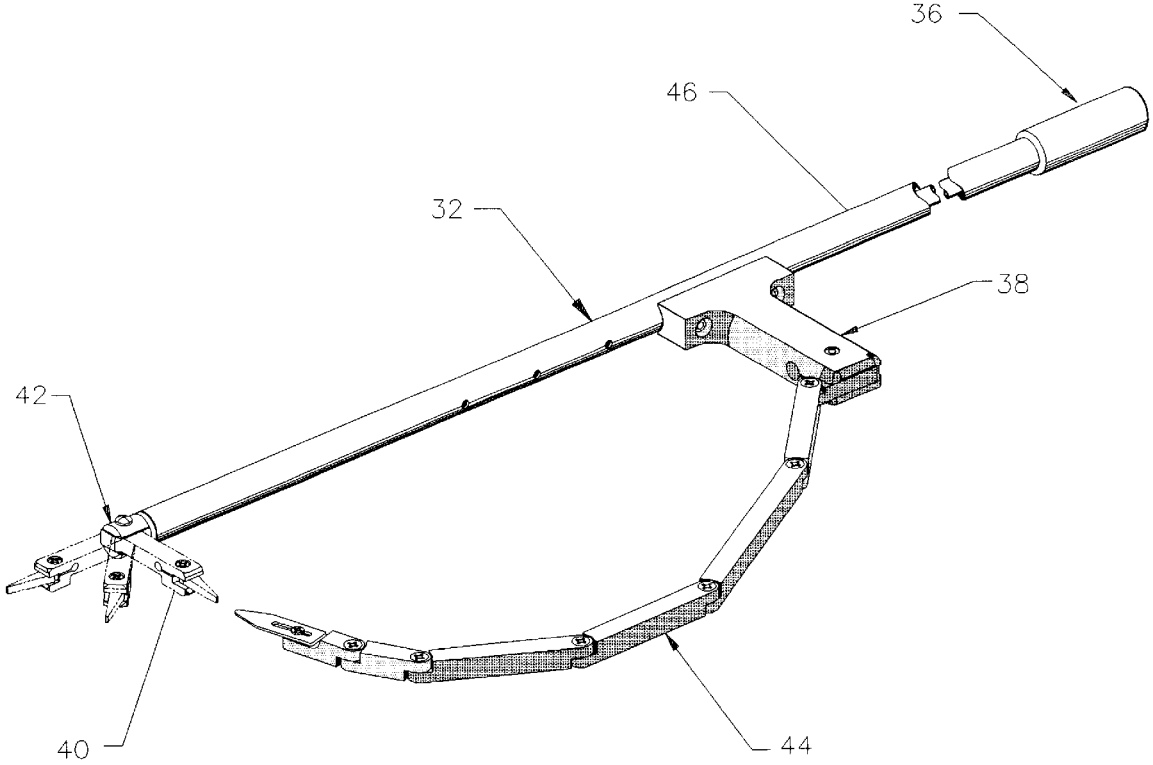
FIG. 2 is a perspective view of a member of the embodiment of FIG. 1.

FIG. 2 contains a further detailed breakdown of the various assemblies that make up bar assembly 32. From left to right in FIG. 2 the front of the bar assembly 32 has an articulating arm 40 shown in its three main positions or articulations. Articulating arm 40 is held by an arm holder assembly 42 in which articulating arm 40 can move 0 degrees to 45 degrees to 90 degrees in relationship to bar assembly 32 and its longitudinal axis. A caliper arm assembly 44 is attached to an outrider assembly 38. Outrider 38 is attached to a barrel 46. A hand knob assembly 36 is threaded into barrel 46 and, through its action locks articulating arm 40 into one of its three positions.

Figure 3:
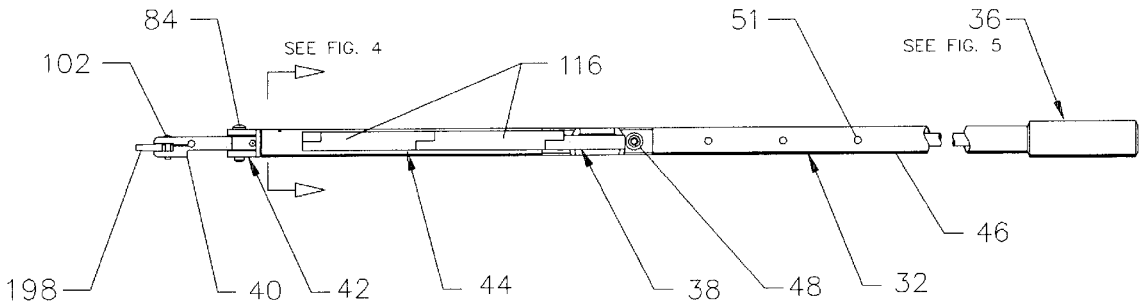
FIG. 3 is a left-hand side view of the embodiment of FIG. 2.

FIG. 3 shows a left-hand side view of bar 32 and the relationship of the different assemblies. From left to right in FIG. 3, a cutting tool 198 is held in articulating arm 40 by an arm screw 102. Articulating arm 40 is held in blade holder 42 at the 0 degree or straightened position by an arm pin 84. Caliper 44 is a plurality of caliper links 116. Outrider 38 is attached by an outrider screw 48 to barrel 46 by a threaded outrider adjustment 51.

Figure 4:
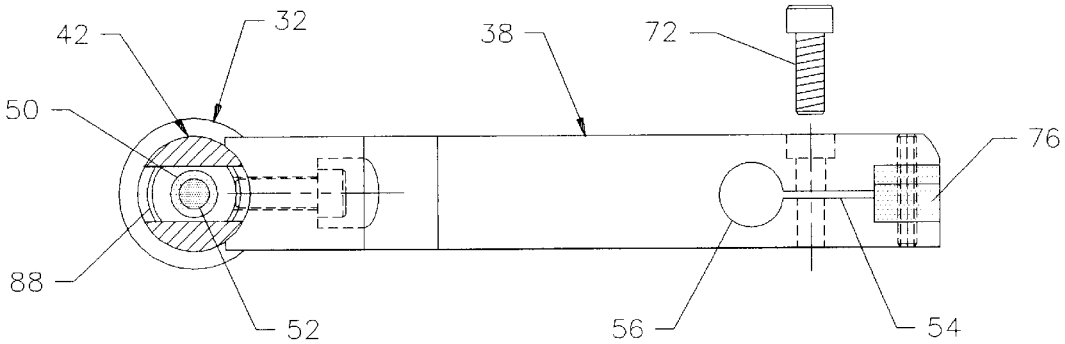
FIG. 4 is a front view of the embodiment of FIG. 2.

FIG. 4 is a front view of bar assembly 32 of FIG. 3. This view also has removed articulating arm 40 and caliper links 116. With articulating arm 40 and an arm pin 84 removed from blade holder 42 an arm holder aperture 88 is shown. Inside aperture 88 is the end of a rod 50 and a pressed bearing 52. Bearing 52 is fitted into the end of rod 50. With caliper links 116 removed the end of a caliper arm 76 is shown. Caliper arm 76 is held in place when a caliper arm set screw 72 is tightened. An outrider slot 54 and an outrider cavity 56 allows caliper arm 76 to be squeezed in place when screw 72 is tightened in outrider 38.

Figure 5:
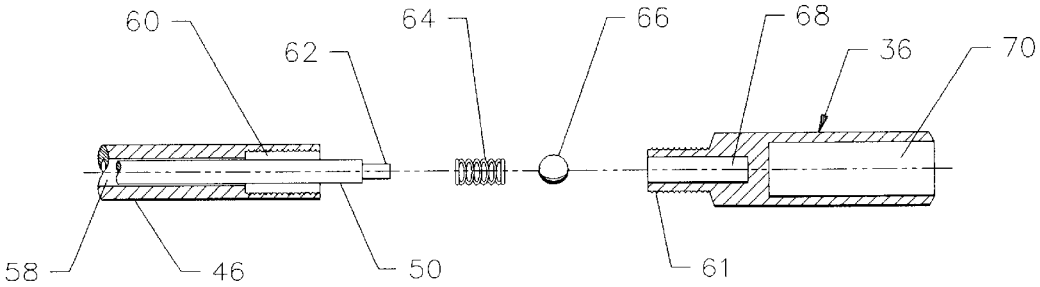
FIG. 5 is an exploded view of the right-hand side of the embodiment of FIG. 2.

FIG. 5 is an exploded view of an end of barrel 46 and hand knob 36. Rod 50 goes through a barrel aperture 58 (and ends at bearing 52 in arm holder aperture 88). A rod stem 62 accepts a spring 64. Stem 62 and spring 64 go into a hand knob cavity 68 with spring 64 riding on a bearing 66 at the end of cavity 68. A threaded knob hole 60 in barrel 46 accepts a threaded knob stem 61. Hand knob 36 is machined out at one end with a hand knob aperture 70.

Figure 6:
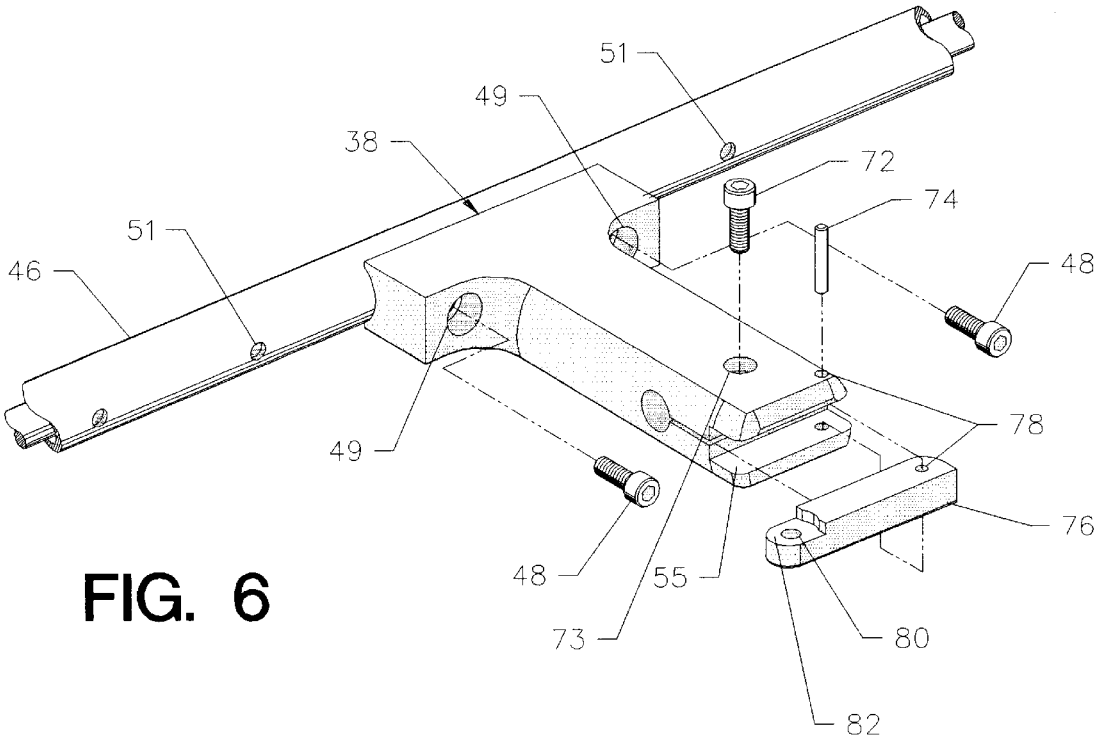
FIG. 6 is an exploded view of a component of the mid-assembly of the embodiment of FIG. 2.

FIG. 6 is an exploded view of outrider assembly 38. FIG. 6 shows the top side of outrider 38. As shown in FIG. 3 and FIG. 6 outrider screws 48 go through an outrider screw opening 49 and into outrider adjustments 51. Caliper arm 76 is held in a closed position by screw 72 which passes through a caliper set screw opening 73 and into a caliper set screw hole 75. When screw 72 is tightened caliper arm 76 is held in a caliper arm slot 55. When screw 72 is loosened caliper arm 76 is allowed to pivot on a caliper hinge pin 74 which passes through a hinge pin opening 78 in outrider 38 and caliper arm 76. Caliper links 116 (not shown in FIG. 6) are attached to caliper arm 76 by seating on a caliper arm flat 82 and held by a screw in a caliper link screw hole 80.

Figure 7:
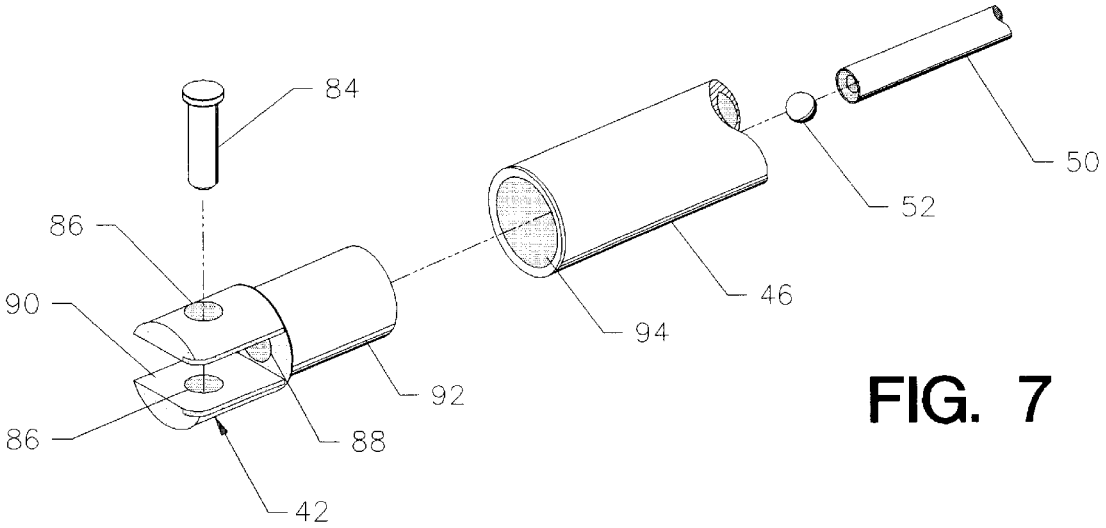
FIG. 7 is an exploded view of a component of the left-hand side of the embodiment of FIG. 2.

FIG. 7 is an exploded view of arm holder assembly 42. Arm pin 84 fits tightly in an arm pin opening 86. Arm holder aperture 88 is shown without rod 50 and bearing 52 as in FIG. 4 but in an exploded view. An arm holder clevis 90 fits the sides of articulating arm 40 (not shown) tightly. An arm holder stem 92 is press fit into a barrel stem orifice 94.

Figure 8A:
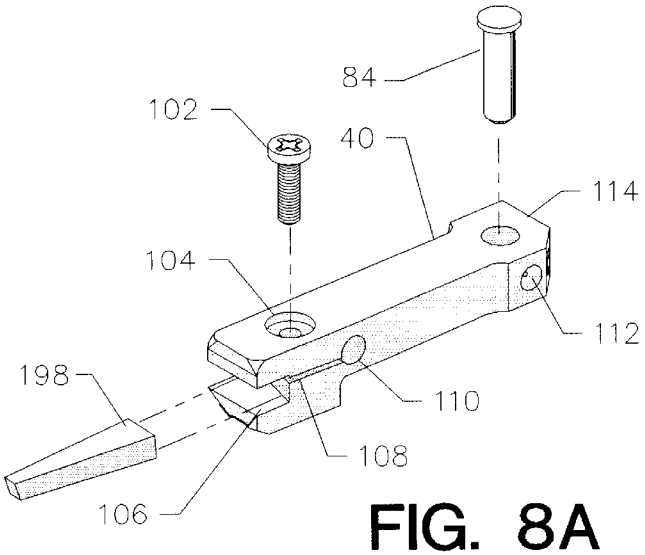
FIGS. 8A through 8C are respectively perspective, rear perspective, and bottom views of a component of the left-hand side of the embodiment of FIG. 2.
Figure 8B:
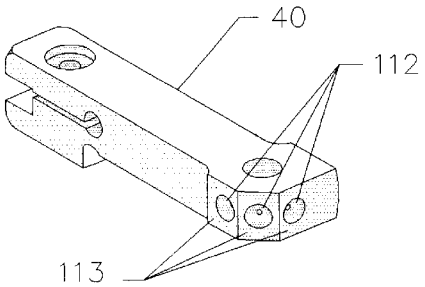
Figure 8C:
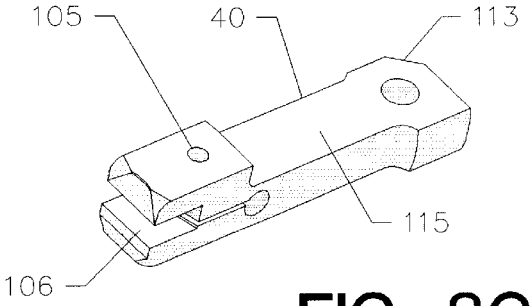
Figure 8D:
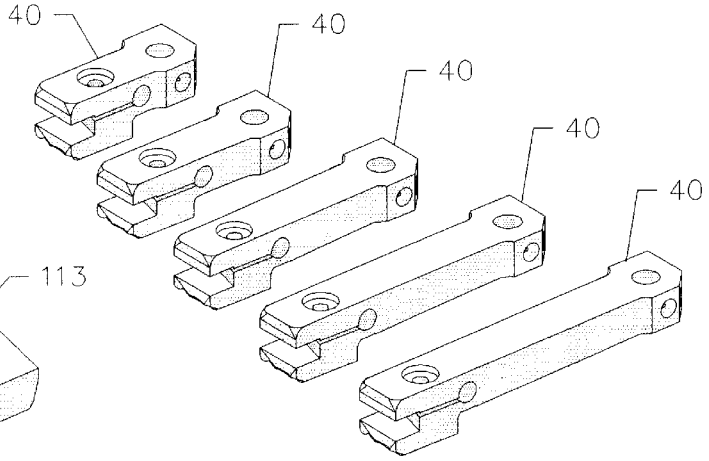
FIG. 8D is a perspective view of different embodiments of FIGS. 8A through 8C.

FIGS. 8A through 8C show articulating arm 40 in different relative positions to help understand its shaping. It is constructed of a hardened steel milled from one piece. An arm mouth 106 in FIG. 8A is accurately milled to accept cutting tool 198, which is held in place when arm screw 102 is placed in an arm screw opening 104 and tightened in a screw hole 105. As screw 102 is tightened an arm slot 108 and an arm cavity 110 allow clamping pressure to be exerted on cutting tool 198. Arm pin 84 is shown above an arm pin aperture 114 where it fits when articulating arm 40 is placed in arm holder clevis 90. Also shown in FIG. 8A is a detent 112 where bearing 52 seats (see FIG. 10). FIG. 8B shows all three detents 112 and all three flats 113 which determine the three positions (0 degrees, 45 degrees and 90 degrees) that articulating arm 40 can be locked into by bearing 52. FIG. 8C shows the underside of articulating arm 40. Arm mouth 106, rabbet 115, flats 113 and detents 112 must all be machined to close tolerances to work properly. FIG. 8D shows the different lengths of blade 40 needed for hollowing-out a limited access opening turned form.

Figure 9:
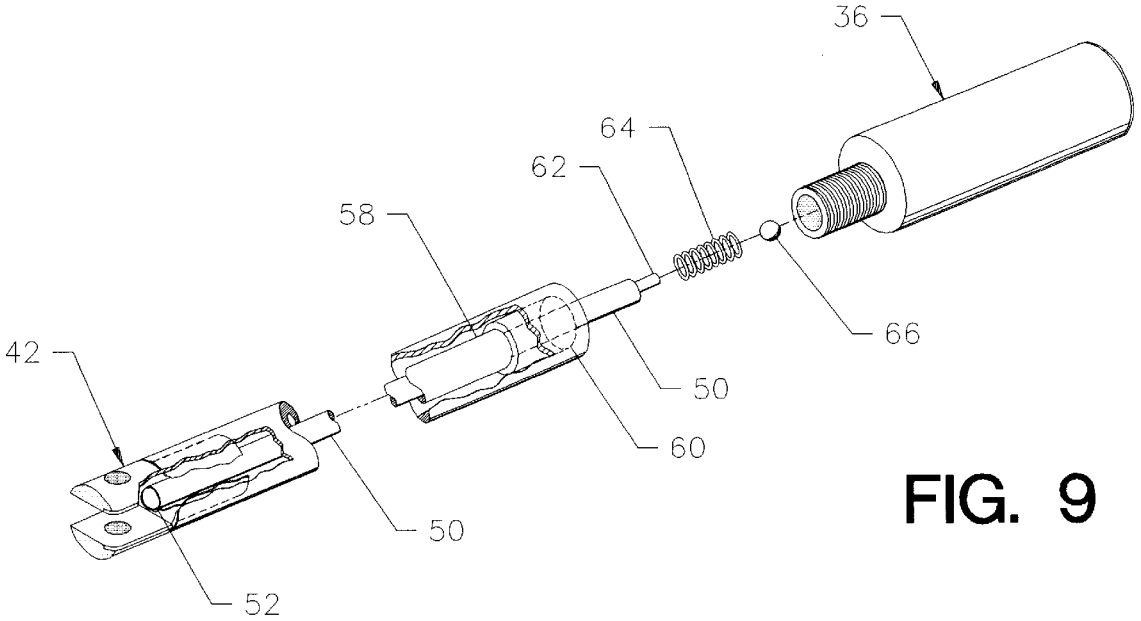
FIG. 9 is an exploded view of an internal assembly of the embodiment of FIG. 2.

FIG. 9 shows rod 50 that goes through barrel aperture 58 of barrel 46. Rod 50 must slide easily through aperture 58, or articulating arm 40 will not be able to move easily to its various positions. Bearing 52 and stem 62 are shown to establish rod 50 position in aperture 58 relative to holder 42 and hole 60. Barrel 46 can be made of some hardened thick wall metal tubing of accurate outside dimensions and aperture 58 not over ⅓ the diameter of barrel 46. Rod 50 can be made of some hardened metal rod, but does not have to be as high quality as barrel 46.

Figure 10:
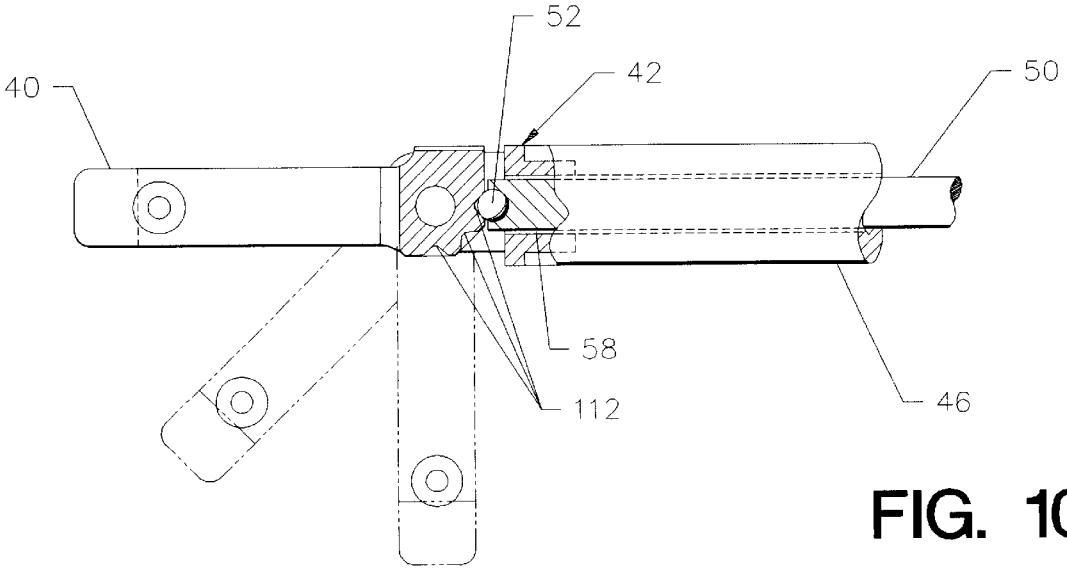
FIG. 10 is a section view of an assembly of the left-hand side of the embodiment of FIG. 2.

FIG. 10 is a section view of arm holder assembly 42 and articulating arm 40. Rod 50 holding bearing 52 is pushed into detent 112 when hand knob assembly 36 (not shown) is tightened. Articulating arm 40 is held in position by bearing 52 being pushed into detent 112 and arm pin 84. Upon relief of pressure on rod 50 bearing 52 can be released from detent 112 by sliding back rod 50 in barrel aperture 58. Upon this release articulating arm 40 can be pivotably moved to one of three positions provided by the three detents 112 or arm pin 84 can be removed so that another articulating arm 40 of different length can be fit into arm holder 42.

Figure 11A:
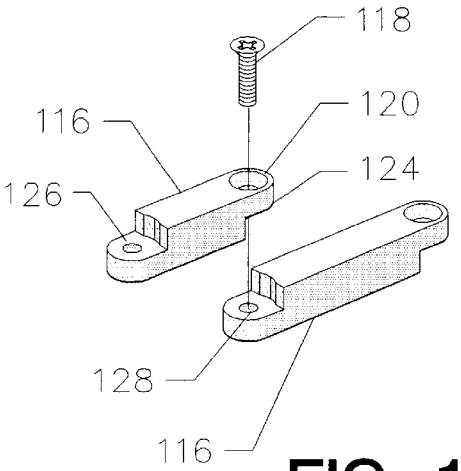
FIG. 11A is a perspective view of a component of the mid-assembly of the embodiment of FIG. 2.
Figure 11B:
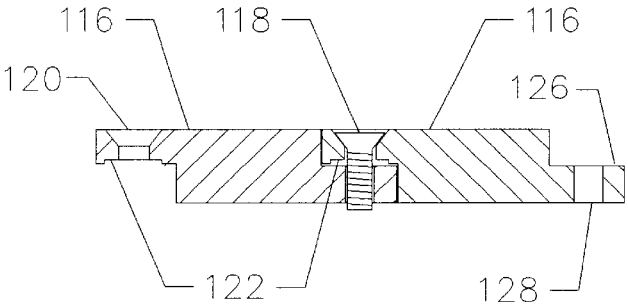
FIG. 11B is a section view of the assembly of FIG. 11A.
Figure 11C:
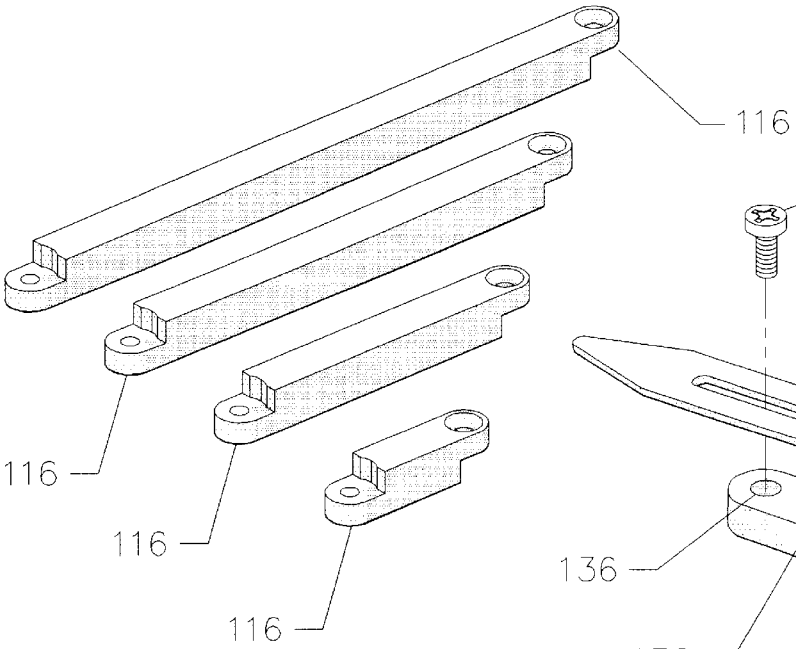
FIG. 11C is a perspective view of different embodiments of FIG. 11A.
Figure 11D:
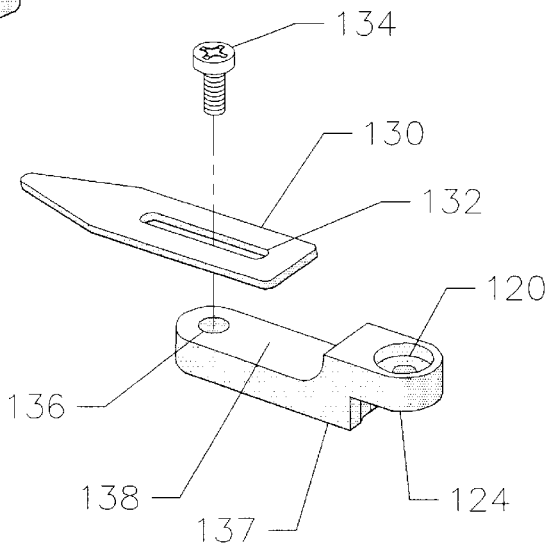
FIG. 11D is a perspective view of a component of the assembly of FIGS. 11A through 11C.

FIG. 11A is a perspective view of caliper link 116 of caliper arm assembly 44. A caliper link screw 118 seats in a link screw opening 120. A link rabbet 124 is then seated on another link 116 on a link register 126, screw 118 being threaded into a link screw hole 128. FIG. 11B is a section view of links 116. Various reference numerals are shown for clarification. The most important aspect of this view is link relief 122 which allows link rabbet 124 to seat fully and accurately on another link 116 on that link's register 126. FIG. 11C shows different lengths of link 116. This plurality of different length links are necessary for the operation of this system. FIG. 11D shows a tip link 137 which is of a slightly different configuration than links 116. A flexible tip 130 is of some type of material that is able to be bent but can retain its original position. Tip 130 is held to tip platform 138 by a tip screw 134 inserted through a tip slot 132 and threaded into a tip screw hole 136. Flexible tip 130 is able to be moved into different positions by loosening screw 134 and sliding tip 130 along slot 132. When tip 130 is in its desired position screw 134 is tightened. Caliper links 116 and tip link 137 are made of some light weight material such as aluminum, plastic, etc. for ease of operation. Rabbet 124, register 126 and relief 122 should be accurately machined to have caliper assembly 44 line up properly for use.

Figure 12:
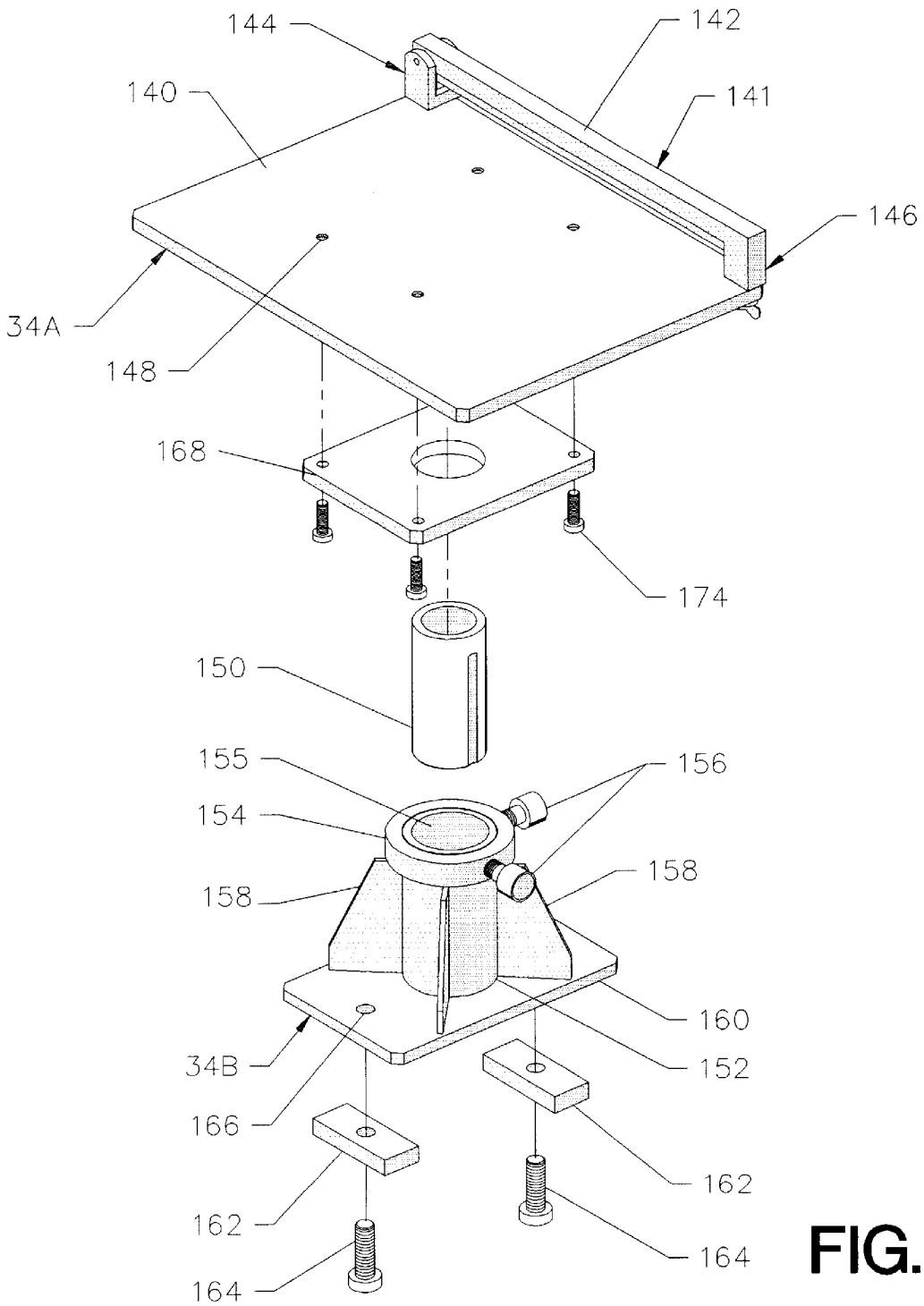
FIG. 12 is a perspective view of a member of the embodiment of FIG. 1.

FIG. 12 is a perspective view of platform assembly 34A and platform mounting assembly 34B. A platform 140 holds restraint assembly 141 comprising a hinged restraint bar 142 with a restraint bar hinge assembly 144 and a restraint bar locking assembly 146. Platform 140 is held to a platform post 150 by a bolt 174 (FIG. 14) threaded into a platform bolt hole 148. Assembly 34B holds a platform assembly 34A by a platform post holder 152, a post holder ring 154 and a post holder set screw 156 which are threaded into ring 154 and can be tightened into post 150 to hold assembly 34A. Post 150 slides inside post holder 152 and can hold platform assembly 34A in a variety of different vertical positions. Gussets 158 help hold and stabilize post holder 152 to a base 160. A platform post hole 155 must be perpendicular to the bottom of base 160.

Figure 13:
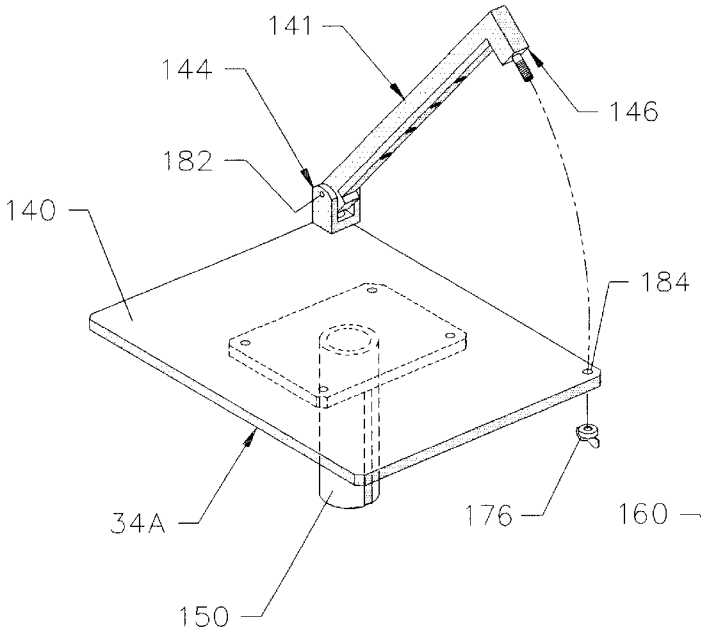
FIG. 13 is a perspective view of a component of the embodiment of FIG. 12.

FIG. 13 shows platform assembly 34A removed from assembly 34B. Restraint assembly 141 is shown in its up or open position. Locking assembly 146 has been released by unscrewing a wing nut 176 and allows restraint bar 142 to be pivotably moved on a screw 182 in hinge assembly 144. Platform 140 can be made of a surfaced metal plate of sufficient thickness to restrain vibration.

Figure 14:
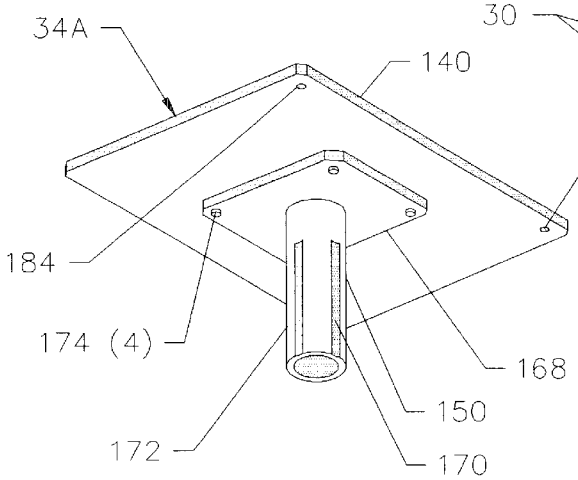
FIG. 14 is an underside view of the embodiment of FIG. 13.

FIG. 14 shows a view of the underside of platform assembly 34A. Post 150 is of a large diameter metal tubing with a post slot 170 and a post flat 172 milled along its longitudinal axis. Post 150 is typically 51 mm in diameter. Slot 170 accepts the end of screw 156 and keeps platform assembly 34A from rotating in post hole 155 thus keeping assembly 34A square to assembly 34B. Flat 172 allows screw 156 to have its end tightened into post 150. Post 150 fits post hole 155 with close tolerances for stability. Post 150 is press-fit into a platform post base 168. Base 168 is bolted by post base bolts 174 to the bottom of platform 140 into bolt holes 148 (see FIG. 12). A hinge post bolt opening 192 is used to hold and align hinge assembly 144 to platform 140. A locking post bolt opening 184 is used to hold and align restraint bar 142 by locking assembly 146 (FIG. 13).

Figure 15:
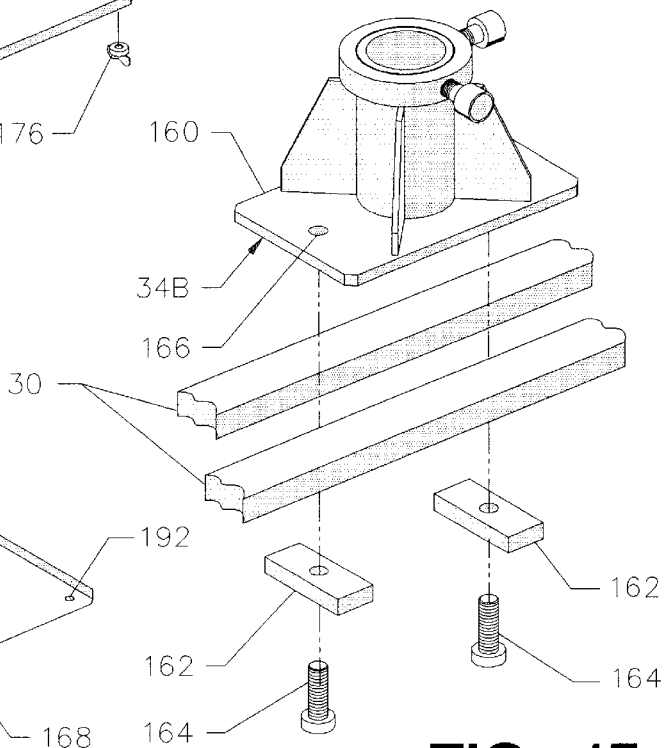
FIG. 15 is a view of a lower portion of the embodiment of FIG. 12.

FIG. 15 shows base 160 held to lathe bed ways 30 by bolt 164 threaded into bolt hole 166. When bolt 164 is tightened into bolt hole 166, base 160 is secured in position by base holder 162 from the underneath of lathe bed 30. Bolt 164 is typically 16 mm diameter.

Figure 16A:
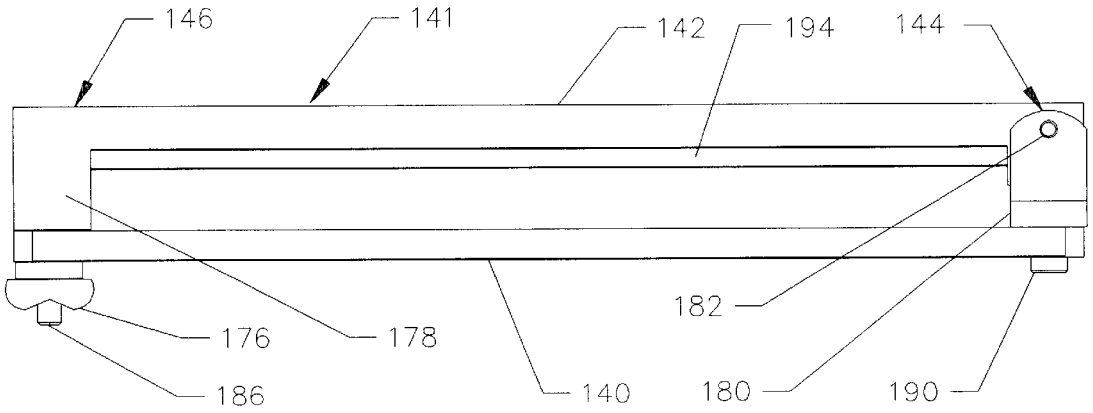
FIG. 16A is a rear view of a top right portion of the embodiment of FIGS. 12 and 13.

FIG. 16A shows a close-up view of restraint assembly 141. Restraint bar 142 is held in position relative to platform 140 by a post 178. A wing nut 176 secures restraint assembly 141 to platform 140 by a bolt 186 through opening 184 (FIG. 14). Upon removal of wing nut 176, restraint bar 142 can be lifted to a vertical position, pivotably moving on a hinge post screw 182 held by a hinge post 180 (FIG. 13). Hinge assembly 144 is secured to platform 140 by a hinge post bolt 190.

Figure 16B:
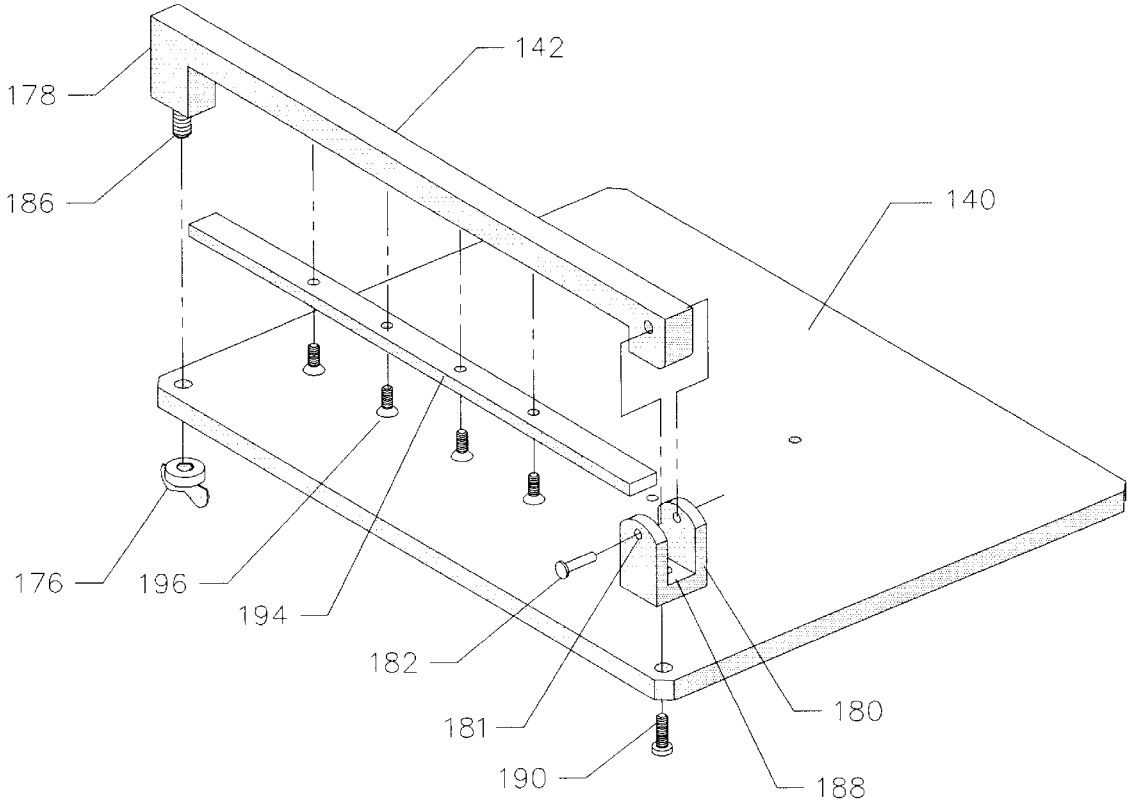
FIG. 16B is an exploded view of the embodiment of FIG. 16A.

FIG. 16B is an exploded view of FIG. 16A, showing different component parts of restraint bar 142. Bolt 186 which passes through opening 184 is shown at the bottom of post 178. A thickness shim 194 is shown removed from restraint bar 142. A screw 196 holds shim 194 to restraint bar 142 when needed. Different thickness shims can be used depending on tooling desired and its diameter or thickness. Hinge assembly 144 and its component parts are shown with bolt 190 that passes through hole 192 (see FIG. 14) and is held to platform 140. Restraint bar 142 is pivotably attached to hinge post 180 by screw 182 which passes through a hole 181 in restraint bar 142 and post 180. Clevis 188 allows acceptance of restraint bar 142 and also acts as a hinge stop to hold the restraint bar in a vertical position when in the open position.

Operation—FIGS. 1, 2, 5–8, 10–12, 15–18

Figure 17A:
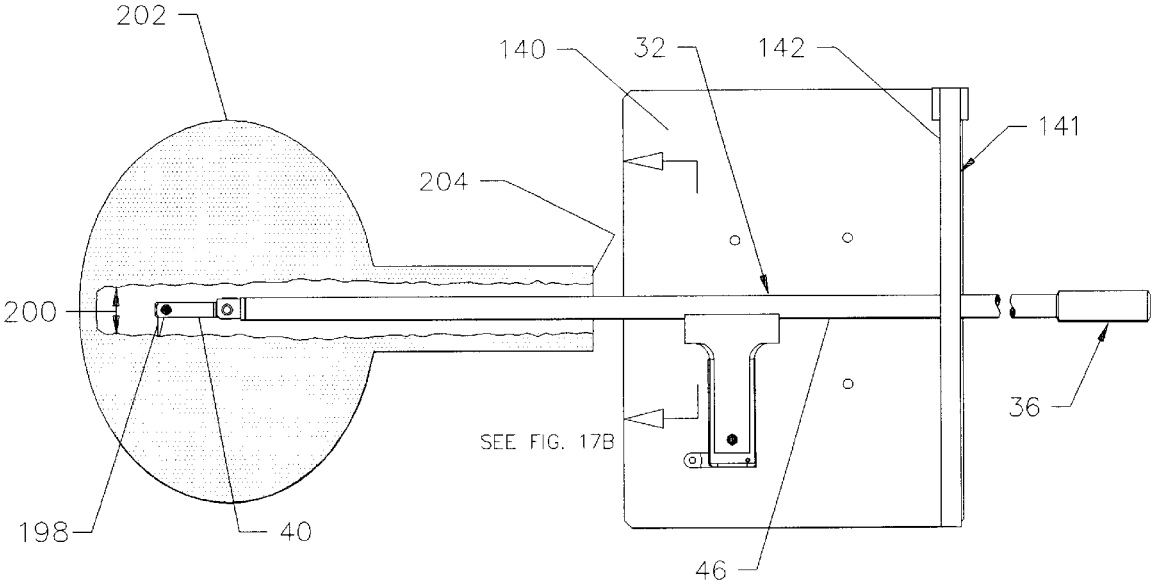
FIGS. 17A through 17G are schematic representations of a portion of the lathe tool assembly for forming an internal cavity using a tool similar to that of the embodiments of FIGS. 1, 2 and 12.
Figure 17B:
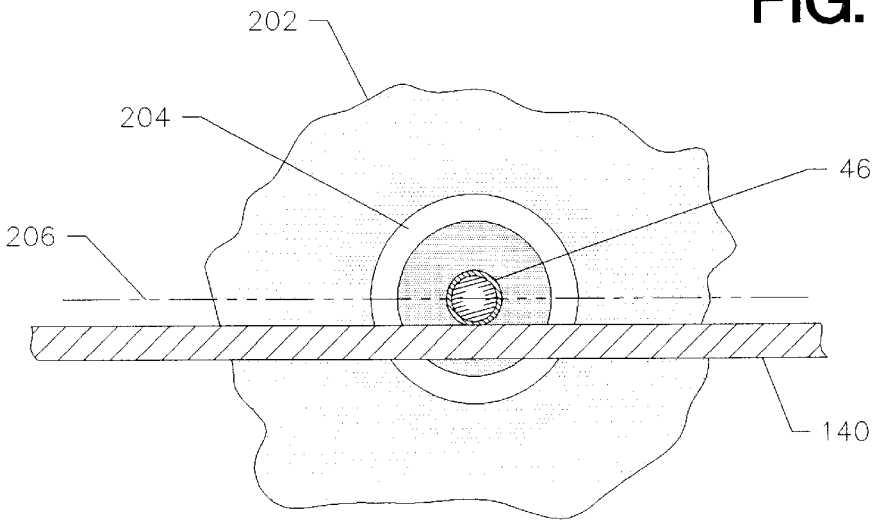

The procedure of using the articulated hollowing system to hollow-out a turned form is of a completely different manner than previous practice. As shown in FIG. 17A after the outside shaping of a turned form 202 is finished a pilot hole 200 is drilled to a pre-determined depth. Form 202 is mounted to a lathe head stock and is ready to begin the hollowing-out process. Platform 34A and 34B is placed on lathe bed ways 30 (FIG. 1 and 12) and positioned so that the leading edge of platform 140 is sufficiently near a mouth 204. Platform mounting assembly 34B is bolted securely to lathe bed ways 30 as shown in FIG. 15. Platform assembly 34A is adjusted for proper height to allow suitable alignment with a lathe head stock. Suitable alignment will allow the center of mouth 204 and barrel 46 to be disposed on a horizontal plane 206 with the lathe headstock axis (FIG. 17B). The predetermined height of platform 140 is secured by tightening screws 156 to post 150. The large mounting area of base 160 and its method of securing to lathe bed ways 30 as described above and the large diameter of post 150 offer a solid basis to control tool pitch, roll and vibration as already discussed.

For the initial removal of material from form 202 articulated bar 32 is set with the short articulating arm 40 in the 0 degree position (FIGS. 2 and 17A). This is accomplished by tightening hand knob 36 which presses bearing 52 held by rod 50 into detent 112 and fixing articulating arm 40 into this position (FIG. 10). To remove and replace articulating arm 40 as shorter or longer lengths are needed hand knob 36 is loosened to relieve pressure from articulating arm 40 by bearing 52. Arm pin 84 is then grasped by the operator and removed from arm holder 42 (FIG. 7). Articulating arm 40 is then removed from arm clevis 90. A different length articulating arm 40 is then placed in clevis 90 aligning aperture 114 with arm pin opening 86 and reinserting arm pin 84.

Cutting tool 198 is held in a 90 degree position in arm mouth 106 of articulating arm 40 by tightening screw 102 when tip 198 is in position. Cutting tip 198 can be adjustably fixed in a variety of positions in arm mouth 106 depending upon the location of material to be removed inside form 202 as will be shown. To begin the initial hollowing-out process bar 32 is inserted in pilot hole 200 and positioned so that material removal begins inside the body of long-necked form 202 as shown in FIG. 17A. With bar 32 inside form 202 and the lathe rotating form 202 the operator lifts bar 32 against restraint bar 142. The clearance between restraint bar 142 and platform 140 is typically 0.50 mm larger than the diameter of bar 32. In this slightly lifted and restrained position tool pitch is non-existent. The downward thrust exerted on cutting tool 198 when a cut is taken inside spinning form 202 is held by the leading edge of platform 140. The consequent upward thrust of the opposite end of bar 32 is held by restraint bar 142. As the operator removes material inside pilot hole 200 and slidably moves bar 32 further down hole 200 towards the base of form 202 tool pitch leverage increases but is fully contained by this system and the operator experiences no physical duress from this increased leverage. The only limitation to the depth of cut that the operator can take is by barrel 46 and its particular vibration periods. The diameter of barrel 46 and the quality and hardness of material used in its manufacture are the main determinants to the distance an operator can extend bar 32 over the leading edge of platform 140 without undue vibration. Platform 34A and 34B will not offer any detrimental vibration of its own if properly manufactured.

When all the material that can be removed from the predetermined setting of assembly 32 (FIG. 17A) is complete, then articulating arm 40 and cutting tool 198 are re-positioned to reach other internal material that needs removal. The capability of articulated bar 32 to be moved and fixed in a variety of positions becomes important to successfully hollow-out form 202 through the limited-access opening determined by its long and narrow neck. Long-necked form 202 is impossible to hollow out with previous practices. The long neck severely restricts the amount of side-to-side and angular movement of barrel 46 (FIG. 17B). This lack of allowed movement with bar 32 is made up for by different length arms 40 (FIG. 8D) that can extend further and further from barrel 46 to reach more material for removal inside form 202. This will be demonstrated further in the specification.

Figure 17C:
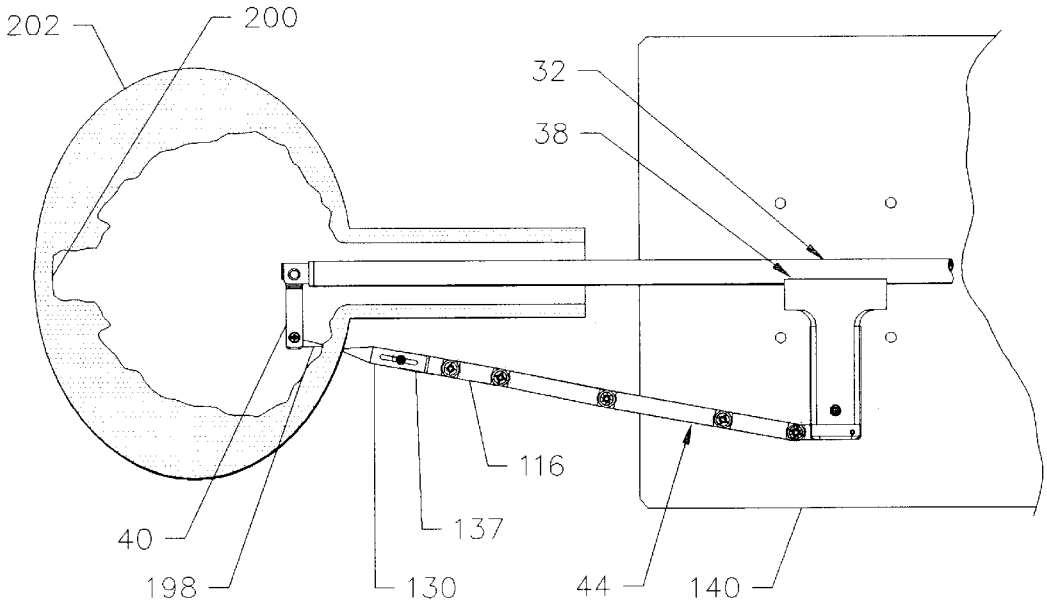
Figure 17D:
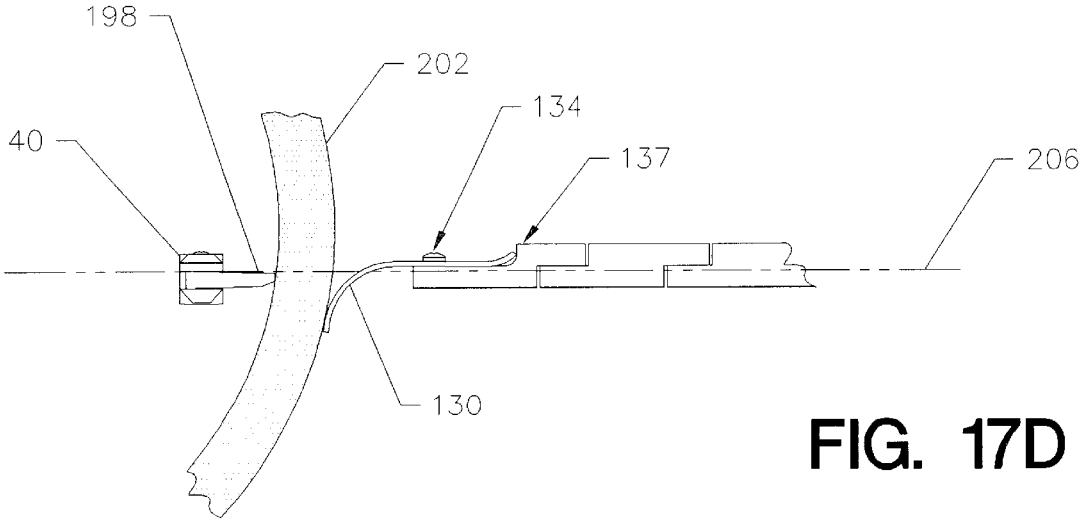

FIG. 17C shows bar 32 with a longer length articulating arm 40 than shown in FIG. 17A. A larger void has been developed in form 202. Articulating arm 40 is locked in the 90 degree position with cutting tool 198 locked in a 90 degree position relative to articulating arm 40. In FIG. 17C the inside top of the void of form 202 is having material removed. Caliper arm assembly 44 is in a predetermined position and is being used to monitor the final wall thickness of form 202 during a cutting action. Cutting tool 198 and flexible tip 130 are set at a predetermined distance from each other. This set distance between the ends of tool 198 and tip 130 is the desired wall thickness. Before this final wall thickness is achieved the flexible tip 130 will deflect downward with the rotation of form 202 (FIG. 17D). As excess material is removed and final wall thickness approached flexible tip 130 will rise until it is in a horizontal position and directly opposite cutting tip 198. Tip 130 will be in horizontal plane 206 when the final wall thickness is achieved.

It is important to keep cutting tool 198 at a perpendicular position relative to the outside shape of form 202 for accurate results in hollowing-out. The ability of tool 198 to be moveably clamped in a variety of positions to keep it perpendicular to the outside shape is achieved by the design of arm mouth 106, slot 108 and cavity 110 (FIG. 8A). It is also important to keep flexible tip 130 opposite and in line with cutting tool 198. This is achieved by lengthening, shortening and curving caliper arm assembly 44 with a plurality of varying length articulating links 116 adjustably fixed to each other. Tip 130 can be rotated, extended or shortened on tip link 137 by tip slot 132 and maintained in its desired position by tightening screw 134 (FIG. 11D). Keeping tip 130 opposite tool 198 as shown in FIG. 17C, 17F and 17G is necessary to achieve an accurate wall thickness. Constant monitoring of the internally disposed cutting tool 198 is necessary to keep from piercing through a thin walled form during a cutting action.

In FIG. 17C articulating arm 40 is in the 90 degree position and tool roll will develop during a cutting action. While cutting, a tool with an offset cutting tip will attempt to roll in the operator's hands. Tool roll is controlled with this system by outrider 38 being slidably held against platform 140. Platform 140 must offer a large flat and smooth surface for outrider 38 to be slidably manipulated on. Tool roll is negated by outrider 38 and the operator cannot discern any effect of it on tool control with this system. Outrider 38 has several adjustment holes 51. If during the hollowing-out process the material to be removed is deeper than the current position of outrider 38 on barrel 46 will allow, outrider 38 can be repositioned by loosening and removing screws 48 (FIG. 6). Once the desired position is determined screws 48 are placed in screw opening 49 and threaded and tightened in outrider adjustments 51. Outrider 38 can be repositioned up and down barrel 46 as needed.

Figure 17E:
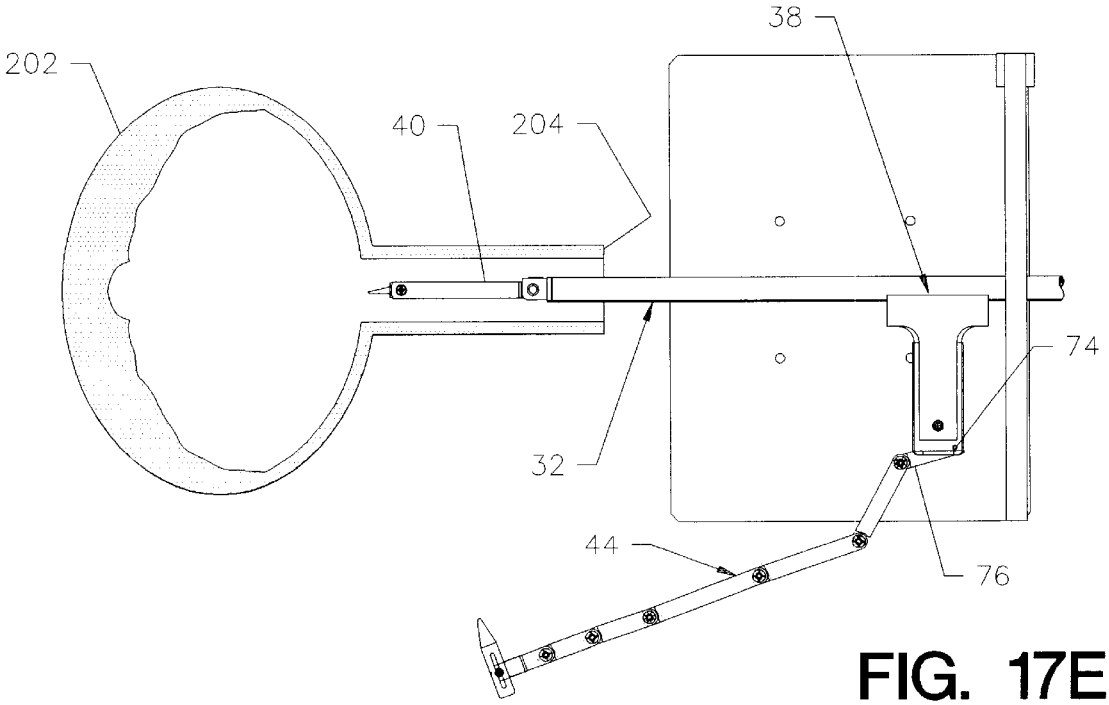
Figure 17F:
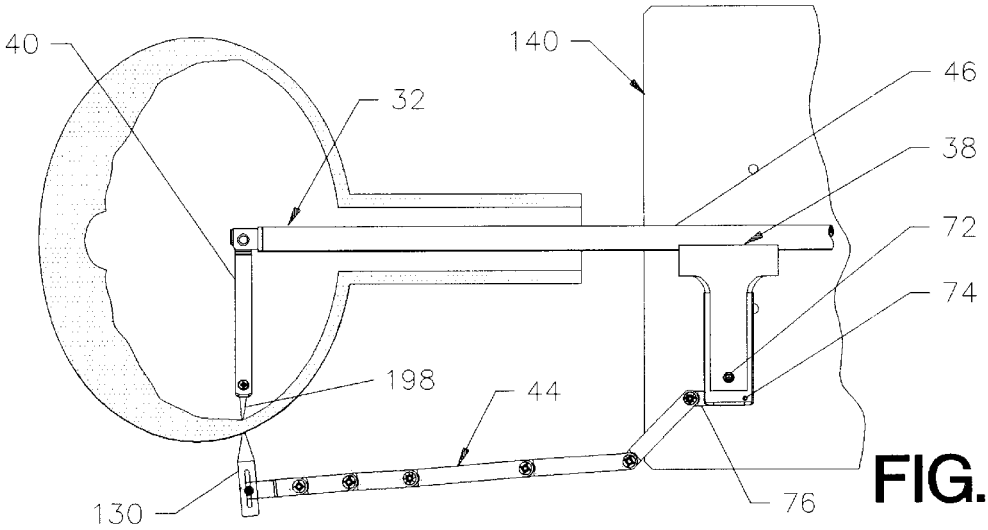
Figure 17G:
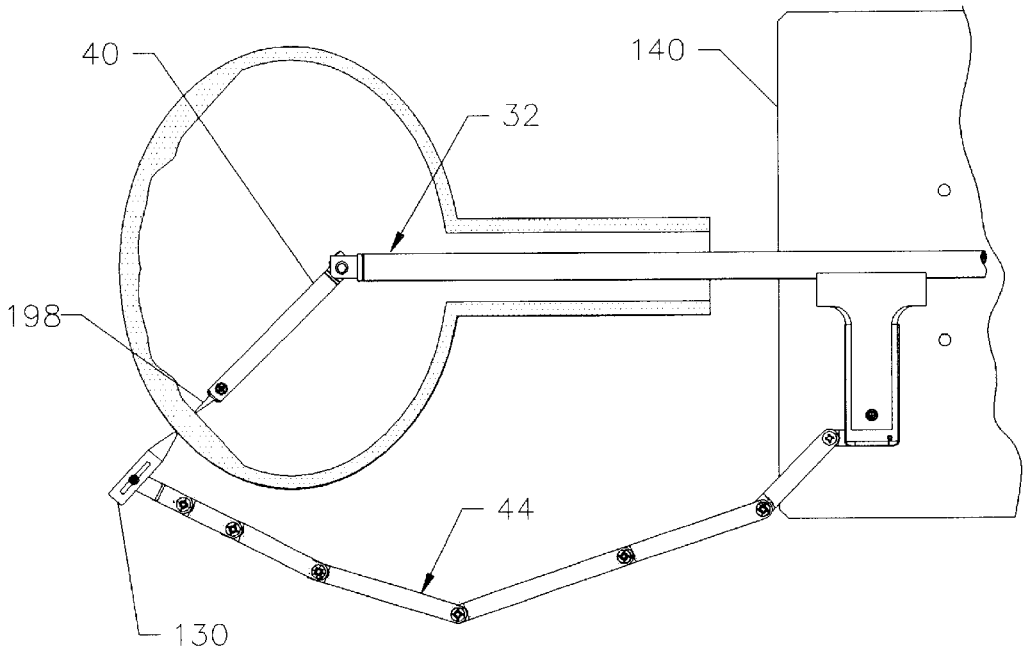

FIG. 17E shows a longer version of articulating arm 40 in the 0 degree position entering mouth 204 of form 202. Caliper arm assembly 44 has been pivoted out of the way. Caliper arm 76 pivotably moves on hinge pin 74 (FIG. 6). When articulating arm 40 is in the 0 degree position and inserted in mouth 204 its position inside the void of form 202 is determined by the number of clicks the operator allows articulating arm 40 to achieve. Spring 64 puts a light pressure on rod 50 (FIG. 5). Bearing 52 is seated in one of three detents 112 and when the position of articulating arm 40 is being changed bearing 42 rides on flat 113 until it clicks into detent 112 from the pressure of spring 64 (FIG. 10). With articulating arm 40 in the 0 degree position the operator simply pushes articulating arm 40 with bar 32 into form 202 and against the bottom or sides of the void in form 202. With one click the operator knows that arm 40 is in the 45 degree position and with two clicks it is in the 90 degree position. In the predetermined position hand knob 36 is tightened which secures articulating arm 40 into a fixed condition (FIG. 17E and 17F). To remove bar 32 from form 202 when articulating arm 40 is in an offset position hand knob 36 is loosened sufficiently to allow articulating arm 40 to be straightened out and click into the 0 degree position (FIG. 17E). Bar assembly 32 is then withdrawn from form 202.

FIG. 17F is the sequence of FIG. 17E and shows articulating arm 40 locked into the 90 degree position with caliper arm assembly 44 moved into position to a predetermined distance from cutting tool 198 and fixed in this position by tightening set screw 72 when caliper arm 76 is pivotably moved into caliper arm slot 55 swiveling on hinge pin 74 (FIG. 6). This design allows accurate re-alignment to a predetermined setting. The ability of this system to have various component parts moveably fixed to allow easy entry into a limited access form and then quickly and accurately re-aligned to a predetermined position allows this type of demanding work to be accomplished accurately.

In FIG. 17F cutting tool 198 is in a 0 degree position relative to the axis of articulating arm 40. Tip 130 will be in a flexed mode disposed against the outside of form 202 as the operator removes material with cutting tool 198 (FIG. 17D). With the amount of offset of articulating arm 40 and the amount of overhang of bar 32 from the leading edge of platform 140 tool pitch and roll would be impossible to control with previous practice. The length of articulating arm 40 in FIG. 17F is a mid-length articulating arm 40. If a larger diameter form 202 is desired articulating arm 40 lengths of up to nine times the diameter of barrel 46 have been used in the same limited-access long-necked mouth 204. Lack of allowed movement of barrel 46 is made up for by incremental lengths of articulating arms 40. Forms of large diameter and depth with a limited-access opening are normal operating procedure with this system.

FIG. 17G shows bar 32 with articulating arm 40 fixed in a 45 degree position being used to remove material on the inside bottom of the void of form 202. Caliper 44 has had links 116 added to it to lengthen it. Caliper 44 also has a slight curvature so that flexible tip 130 can be positioned opposite and in line with tool 198. The operator is again using the predetermined position of tip 130 and tool 198 to monitor the position of the internally disposed cutting tool during a cutting action to arrive at a predetermined wall thickness. Previous practice would have the operator stop the lathe often and attempt to get a measurement of the wall thickness. Then the operator would have to restart the lathe and with the cutting tool relocate the material that needs to be removed without accurate guidance. Measuring the wall thickness at the bottom of form 202 in FIG. 17G would be extremely difficult with previous practice. With this system the locating of material that needs to be removed is disclosed while the form is turning and the material can be removed. The operator does not have to stop and restart the lathe to monitor wall thickness.

Figure 18A:
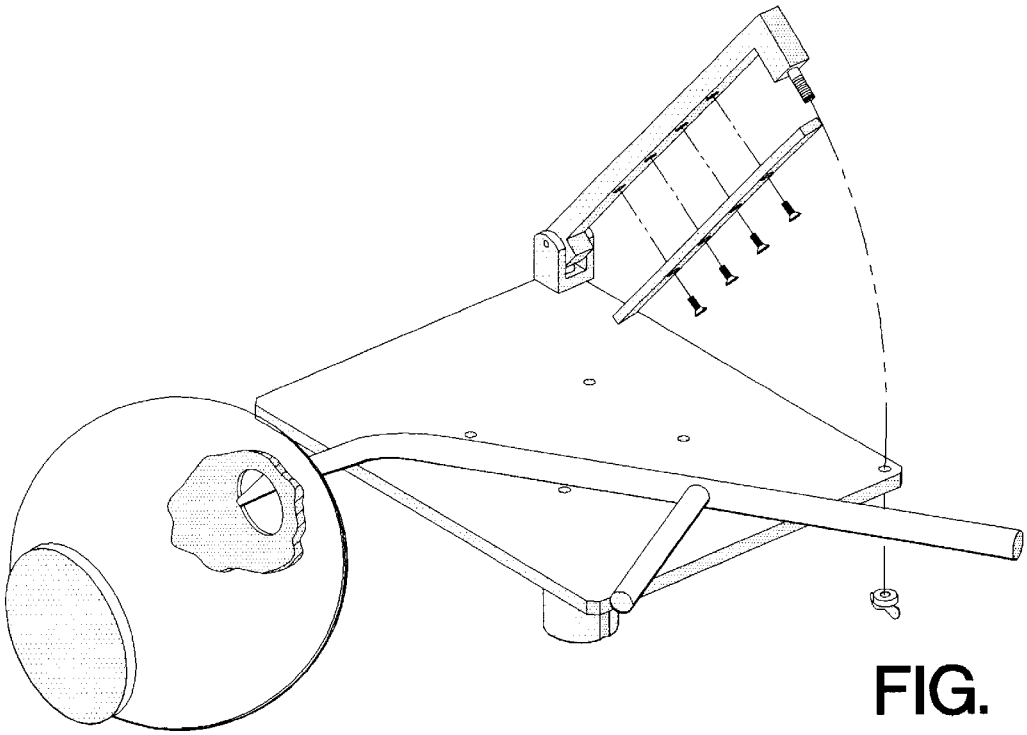
FIGS. 18A and 18B are a schematic representation of a lathe tool being used with the embodiment of FIG. 12.

FIG. 18A shows a fixed offset lathe tool 208 with its cutting tip about to enter form mouth 204. This lathe tool is of a larger diameter than bar 32. Thickness shim 194 is being removed from restraint bar 142 to accommodate its larger size (see FIG. 16B). Restraint assembly 141 is in a raised or open position to allow tool 208 to enter form 212. A simple outrider 210 has been attached to previous practice tool 208.

Figure 18B:
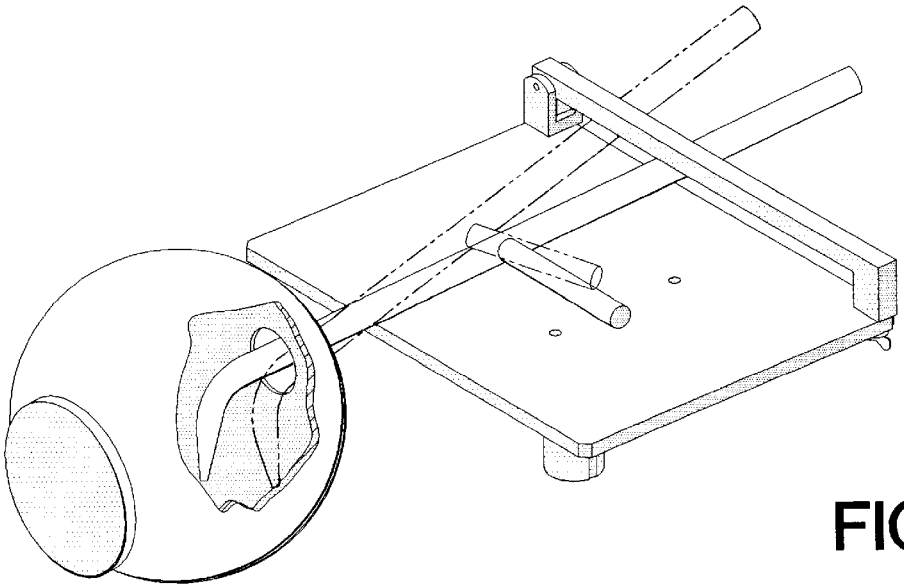

FIG. 18B shows tool 208 inside partially hollowed-out form 212. With thickness shim 194 removed restraint assembly 141 has been returned to its locked position holding tool 108. A fixed restraint assembly 141 to platform 140 would not allow entry of tool 208 into form 212. Tool roll and pitch are controlled with this slightly altered previous practice tool 208 by the addition of outrider 210 and using it with platform assembly 34A and 34B.

Summary, Ramifications and Scope

Accordingly, the reader will see that the methods of this invention with its boring bar and adjustably fixed articulating arms, moveably clamped cutting tool and adjustably fixed articulated caliper assembly can be easily used to hollow-out a variety of turned forms that would prove impossible with previous practices. The articulations of the various component parts of the boring bar assembly allow the lathe operator to quickly reach and remove internally disposed material with conditions that are highly restrictive to tool movement. The easily adjusted articulations of the caliper assembly allow the operator to achieve a high degree of accuracy when hollowing-out to a predetermined wall thickness. The operator is able to make numerous fine adjustments to the system to attain a precisely finished inside wall.

The problems of tool pitch and roll are negated by the system thus providing the operator with safety, ease of operation and a lack of operator fatigue from physical stress. Persons of little or no experience with this type of work can learn to use this system rapidly, without the difficulty and anxiety of previous practice methods. However, the versatility offered by this system will challenge the advanced lathe operator with design and technical possibilities that have not been seriously considered.

Furthermore the articulated hollowing system has the additional advantages in that

- it will permit production work of hollowed turned forms in a variety of materials for a variety of purposes due to its speed and ease of operation.
- it will allow hollowing-out to be done quickly because aggressive cutting tools can be used to quickly remove material and still maintain operator control during a cutting action.
- it can be used on most lathes with little or no adaptation necessary.
- it will permit previous practice tools with slight modification to be used with it.
- it will permit hollowing-out methods to be taught at learning institutions with shop facilities.

Due to the safety and ease of operation, the inexperienced can use this system with little supervision.

While my above description contains many specificities, these should not be construed as limitations on the scope of the invention, but rather as an exemplification of one preferred embodiment. Many other variations are possible. For example there are other methods and techniques for getting a boring bar to articulate. Besides other strictly mechanical methods, techniques can be used that are pneumatic, hydraulic, electrical, etc. There are many methods of holding the cutting tool on the articulated arm assembly. Other techniques could be used by an operator to ascertain the location of the internally disposed cutting tool inside a hollowed form such as x-ray, metal detectors, light, etc. There are other strictly mechanical or automatic systems that could be used to keep track of cutting tool position during a cutting action. The platform assembly could be done away with as the preferred way to hold the articulated boring bar. A system such as the saddle and cross slide on a metal lathe could be used to hold the articulated boring bar and move mechanically or automatically by computer rather than manually on the platform. With some adaptations to the preferred embodiment of the articulated boring bar and methods of controlling it, the bar could be used to hollow-out very hard materials such as are commonly used in the metal working industry.

Thus, the scope of the invention should be determined by the appended claims and their legal equivalents, rather than by the examples given.

I claim:

1. A method for blind cutting an internal void in a lathe turned form through a limited access opening comprising the steps of: providing a boring bar disposed by a biasing means for use on a lathe, and placing said boring bar through said limited access opening into a pre-drilled hole in said lathe turned form, and providing an adjustably fixed articulating arm with a cutting tool means extended laterally from said boring bar to permit an offset cutting action, and fixing said articulating arm to a predetermined position to permit said offset cutting action, and removing material as can be cut away to enlarge said pre-drilled hole with said cutting tool from said predetermined position of said articulating arm, and determining the position of the internally disposed cutting tool in relationship to said lathe turned form's exterior by an adjustment means during said cutting action, and repeating the above steps with successive settings, and changing the length and the angle of said articulating arm and thus incrementally changing the cutting diameter and position of said cutting tool, and cutting with said successive settings inside said turned form through said limited access opening, said internal void is successively and incrementally enlarged, and cutting to a predetermined wall thickness by said adjustment means for determining said cutting tool's internal position, and whereby said turned form will be hollowed out to said predetermined wall thickness with an internal shape that can substantially mirror the external shape of a multitude of turned form designs.

2. The method of claim 1 wherein providing a clevis and pin arrangement to hold said articulating arm to said boring bar end and allow removal thereof.

3. The method of claim 1 wherein fixing said articulating arm in a predetermined position providing a change in said angle of said articulating arm by a screw driven clamping means on an end of said boring bar opposite said clevis and pin arrangement that can fix said articulating arm in a predetermined position.

4. The method of claim 1 wherein the incremental changes of the cutting diameter of said cutting tool is accomplished by providing a plurality of different lengths of said articulating arms which are interchangeable thereof with said boring bar end.

5. The method of claim 1 wherein said cutting tool means is accomplished by providing a moveably clamped cutting tool on an end of said articulating arm.

6. The method of claim 1 wherein said determination of the position of said internally disposed cutting tool during said cutting action is accomplished by providing a plurality of varying length articulating members providing an adjustably fixed caliper arm assembly for determining the position of said internally disposed cutting tool.

7. A system for blind cutting an internal void in a lathe turned form through a limited access opening comprising; a boring bar of tubular construction positioned by a biasing means for use on a lathe; said boring bar with clamping means for attachment of an adjustably fixed articulating arm on an end of said boring bar; adjustment means for sequential increase and decrease in the amount of offset of said articulating arm in relationship to said boring bar; means for changing the angle of said articulating arm; a cutting tool means on the end of said articulating arm; clamping means for fixing said articulating arm for internal cutting of said lathe turned form by said cutting tool; adjustment means for determining the position of the internally disposed cutting tool in relationship to said turned form's exterior to arrive at a predetermined wall thickness during a blind cutting action; through a multitude of successive settings changing the amount and angle of offset of said articulating arm and thus incrementally changing the cutting diameter and position of said cutting tool, and a void may be incrementally developed inside said turned form through said limited access opening of large and changing diameters; whereby said turned form will be hollowed out to said predetermined wall thickness with an internal shape that can substantially mirror the external shape of a multitude of turned form designs.

8. The system of claim 7, and wherein said articulating arm is attached to said boring bar by a clevis and pin arrangement, and said pin may be removed to allow removal or exchange of said articulating arm with another thereof.

9. The system of claim 7, and further including a rod of predetermined size occupying an aperture of said tubular boring bar allowing a screw driven clamping means on an end of said boring bar to fix said articulating arm in a predetermined position.

10. The system of claim 9, and further including detents in the end of said articulating arm that said rod may engage with to fix said articulating arm in a predetermined position.

11. The system of claim 7 wherein said cutting tool is moveably clamped to an end of said articulating arm.

12. The system of claim 7 wherein said means for determining the position of said internally disposed cutting tool is made of a plurality of varying length articulating members adjustably fixed to each other to allow changes in length and shape of said plurality of members acting as a caliper arm assembly when fixed to each other to aid in the determination of the position of said internally disposed cutting tool.

13. The system of claim 12, further including a means of pivotable attachment of said caliper arm assembly to an outrider.

14. The system of claim 13, further including a means to fix said pivotably attached caliper assembly in a predetermined position, and allowing said caliper assembly to be pivotably moved repeatedly and realigned accurately to said predetermined position.

15. The system of claim 12, further including a member of flexible material adjustably fixed on an end of said caliper assembly allowing said flexible member to be fixed in a predetermined position relative to said cutting tool to determine its position thereof during a cutting action without destroying said predetermined position.

16. A system for the hand manipulation of an offset boring bar during the hollowing out of a lathe turned form comprising; a boring bar assembly of a predetermined length and diameter disposed on a support platform of a predetermined size and a predetermined height above and parallel to a lathe bed in suitable alignment with a lathe headstock; said platform is held by a support assembly and clamped to said lathe bed; an offset member of a predetermined length on an end of said boring bar to permit an offset cutting action; a cutting tool on the end of said offset member for removal of internal material; an outrider extending laterally a predetermined length from the side of said boring bar, and mounted on the side thereof in line with said articulating arm; a restraint assembly disposed at the back of said platform opposite said cutting action sandwiching said boring bar between said restraint assembly and said platform; said boring bar and said outrider are manipulated slidably by an operator on said platform; said outrider restrains rotational movement of said boring bar about its longitudinal axis during said offset cutting action; said boring bar is manipulated slidably by said operator between said restraint assembly and said platform; a front edge of said platform restraining a downward pitch of said boring bar's cutting end during a leveraged cutting action; said restraint assembly restraining an upward pitch of the end opposite said boring bar's cutting end during said leveraged cutting action; whereby said boring bar is restrained from tool roll during said offset cutting action and restrained from tool pitch during said leverage cutting action.

17. The system of claim 16 wherein an adjustably fixed means of attaching said outrider to said boring bar to allow varying depths of cuts to be taken with said boring bar from said front edge of said platform and keep said outrider disposed on said platform.

18. The system of claim 16, and further including an adjustably fixed means of pivotable attachment of said restraint assembly to said platform and clamping means for fixing said restraint assembly to said platform to restrain said tool pitch of said boring bar.

19. The system of claim 16 wherein said support assembly allows vertical adjustment of said platform to allow suitable alignment to be maintained with said lathe headstock.

20. The system of claim 16 wherein said support assembly is able to be moveably fixed on said lathe bed.

* * * * *